US012553190B2

(12) United States Patent
Casas

(10) Patent No.: US 12,553,190 B2
(45) Date of Patent: Feb. 17, 2026

(54) TAMPING MACHINE, RAIL WORKS TRAIN AND METHOD FOR OPERATING SUCH A TRAIN

(71) Applicant: Matisa Materiel Industriel S.A., Crissier (CH)

(72) Inventor: Gabriele Casas, Crissier (CH)

(73) Assignee: Matisa Materiel Industriel S.A., Crissier (CH)

( * ) Notice: Subject to any disclaimer, the term of this patent is extended or adjusted under 35 U.S.C. 154(b) by 702 days.

(21) Appl. No.: 17/906,635

(22) PCT Filed: Mar. 18, 2021

(86) PCT No.: PCT/EP2021/057033
§ 371 (c)(1),
(2) Date: Sep. 19, 2022

(87) PCT Pub. No.: WO2021/186008
PCT Pub. Date: Sep. 23, 2021

(65) Prior Publication Data

US 2023/0142608 A1 May 11, 2023

(30) Foreign Application Priority Data

Mar. 20, 2020 (FR) ..... 2002755

(51) Int. Cl.
*E01B 27/16* (2006.01)

(52) U.S. Cl.
CPC ..... *E01B 27/16* (2013.01)

(58) Field of Classification Search
CPC ..... E01B 27/06; E01B 27/12; E01B 27/13; E01B 27/16
See application file for complete search history.

(56) References Cited

U.S. PATENT DOCUMENTS 4,165,694 A 8/1979 Theurer
4,430,944 A 2/1984 Theurer
(Continued)

FOREIGN PATENT DOCUMENTS

CH 648621 A5 3/1985
CN 1041800 A 5/1990
(Continued)

OTHER PUBLICATIONS

International Search Report and Written Opinion mailed May 12, 2021, in connection with International Patent Application No. PCT/EP2021/057033, filed Mar. 18, 2021, 10 pgs. (including translation).

(Continued)

*Primary Examiner* — Robert J McCarry, Jr.
(74) *Attorney, Agent, or Firm* — Chiesa Shahinian & Giantomasi PC

(57) ABSTRACT

A tamping machine for a works train for laying, repairing or replacing a rail track has a first truck and a second truck that are situated longitudinally at a distance from one another, a machine frame and a tamping shuttle, the tamping shuttle having a shuttle frame and one or more tamping units that are vertically movable with respect to the shuttle frame, the shuttle frame being linked to the machine frame by longitudinal guide means that allow a relative back-and-forth movement, between two end-of-travel positions, between the shuttle frame and the machine frame in a longitudinal direction of the tamping machine. The machine frame is entirely supported by the shuttle frame, which is carried by the first truck (20) and the second truck.

18 Claims, 6 Drawing Sheets

(56) References Cited

U.S. PATENT DOCUMENTS

| | | | | |
|---|---|---|---|---|
| 4,632,037 | A | 12/1986 | Theurer et al. | |
| 4,644,868 | A | 2/1987 | Theurer et al. | |
| 4,928,599 | A * | 5/1990 | Hansmann ..... | E01B 27/17<br>104/7.2 |

FOREIGN PATENT DOCUMENTS

| | | | |
|---|---|---|---|
| DE | 2738750 | A1 | 6/1978 |
| DE | 3425637 | A1 | 12/1985 |
| EP | 0360950 | A1 | 4/1990 |
| FR | 2476708 | A1 | 8/1981 |
| FR | 2550808 | A1 | 2/1985 |
| FR | 2556752 | A1 | 6/1985 |
| GB | 2151675 | B | 5/1987 |

OTHER PUBLICATIONS

Office Action mailed Jun. 6, 2025, in connection with Chinese Patent Application No. 202180013981.1, 10 pgs. (including translation).

* cited by examiner

TAMPING MACHINE, RAIL WORKS TRAIN AND METHOD FOR OPERATING SUCH A TRAIN

CROSS-REFERENCE TO RELATED APPLICATIONS

This application is a national stage under 35 U.S.C. 371 of International Patent Application Serial No. PCT/EP2021/057033, filed Mar. 18, 2021, which claims priority to: French Patent Application No. 2002755, filed Mar. 20, 2020; the disclosures of all are incorporated herein by reference in their entirety.

TECHNICAL FIELD OF THE INVENTION

The invention relates in particular to works for laying, maintaining or repairing a rail track. It relates more specifically to operations referred to as tamping, which consist in having tamping tools penetrate the ballast in the gap between the sleepers of the rail track, in order to mechanically compact the ballast under the sleepers.

PRIOR ART

The tamping machines are typically integrated in works trains, which comprises a plurality of cars that are coupled to one another, in order to perform successive operations required for laying, repairing or replacing the rail track. A works train of this kind is capable of advancing continuously, at a low speed, on the rail track, without stopping, and preferably at a constant work speed, each train machine having to provide its own functions at this work speed. The tamping operation, in turn, requires the part of the tamping machine which supports the tamping tools to remain stationary with respect to the rail track, for the time necessary for the tamping tools to penetrate into the ballast between two successive sleepers of the track, for the generation of a vibratory movement of the tamping tools in the ballast, and then for the retraction of the tamping tools from the ballast.

In order to reconcile these conflicting requirements, architectures of tamping machines are known, illustrated for example by the documents FR2476708 and FR2556752, in which the tamping machine comprises a machine frame that is borne by two trucks arranged at the ends thereof, and a tamping shuttle comprising a shuttle frame that is suspended from the machine frame and guided longitudinally in translation with respect to the machine frame, by slides, between two end-of-travel positions, the shuttle frame bearing tamping tools that are movable perpendicularly to the plane of the rail track. The machine frame is intended to be coupled to other cars of a works train and to advance at a constant work speed, on the rail track. During a tamping cycle, the tamping shuttle moves with respect to the machine frame, in the direction opposed to the advancement direction of the machine train, from an initial position, at a speed that is equal in absolute value to the advancement speed, so as to remain immobile with respect to the track during the phase of penetration of the tools into the ballast, of generation of the vibratory movement of the tools in the ballast, then of retraction of the tamping tools out of the ballast. Then, once the tamping tools are retracted, the shuttle frame returns towards its initial position in order to start a new cycle under the following sleeper of the track. In the case of a machine of this type, the slides for longitudinal guidance of the shuttle frame with respect to the machine frame must allow a longitudinal relative movement between the two trucks, while withstanding the stresses in reaction to the stresses of penetration of the tamping tools into the ballast, in a vertical direction perpendicular to the longitudinal movement direction of the shuttle frame. The stresses applied to the guide slides thus vary significantly during the operating cycles, which can bring about rapid wear of the slides.

According to a variant shown in document FR2 550 808, the machine frame is still borne by two end trucks, but no longer bears the shuttle frame in its entirety, which is borne by mounts on two additional bearing trucks which travel on the rail track and are equipped, if applicable, with braking and drive structure. The only connection remaining between the two frames and a jack acting longitudinally in order to allow the alternate movement of the shuttle frame with respect to the machine frame. In the case of such a machine comprising four trucks, it is the weight of the shuttle frame which alone balances the stress of penetration of the tamping tools into the ballast, without taking advantage of the weight of the machine frame. The high number of trucks renders this design complex and expensive.

DISCLOSURE OF THE INVENTION

The invention aims to overcome the disadvantages of the prior art and to propose an alternative tamping machine architecture which allows for a continuous advancement, preferably without stopping, of the tamping machine, while ensuring a step-by-step advancement of the tamping shuttle which bears the tamping tools.

In order to achieve this, according to a first aspect of the invention a tamping machine for a works train for laying, repairing or replacing a rail track is proposed, the tamping machine comprising a first truck and a second truck that are located longitudinally at a distance from one another and are intended for supporting the tamping machine, a machine frame and a tamping shuttle, the tamping shuttle having a shuttle frame and one or more tamping units that are vertically movable with respect to the shuttle frame, the shuttle frame being linked to the machine frame by longitudinal guide structure that allow a relative back-and-forth movement, between two end-of-travel positions, between the shuttle frame and the machine frame in a longitudinal direction of the tamping machine, characterized in that the machine frame is entirely supported by the shuttle frame which is borne by the first truck and the second truck. Thus, a tamping machine is achieved having a limited number of trucks, and the longitudinal guide structure of which are subjected to vertical stresses which do not vary over the course of the operating cycles of the machine, since these stresses are only those resulting from the weight of the machine frame and the elements which said frame bears.

According to one embodiment, the longitudinal guide structure comprise a first longitudinal rolling interface that is closer to the first truck than to the second truck, and a second longitudinal rolling interface that is closer to the second truck than to the first. Preferably, the first rolling interface and the second rolling interface each comprise at least one longitudinal raceway and at least one associated roller which is capable of rolling on the raceway in order to allow for the back-and-forth relative movement between the shuttle frame and the machine frame, the longitudinal raceway being rigidly connected to one of the two subassemblies formed by the machine frame and the shuttle frame, the associated roller being either translationally secured to the other of the subassemblies formed by the machine frame and the shuttle frame, or guided so as to roll simultaneously on the longitudinal raceway and an opposing longitudinal raceway that is rigidly connected to the other of the subassemblies formed by the machine frame and the shuttle frame.

Preferably, the longitudinal raceway of each of the first and second rolling interfaces is rigidly connected to the machine frame, and the associated roller is mounted so as to rotate about a horizontal axis of rotation that is fixed with respect to the shuttle frame, and located longitudinally between at least one wheel set of the first truck and one wheel set of the second truck. For the purpose of a good balance of stresses, the machine frame has a center of gravity that is located between the first rolling interface and the second rolling interface.

In a more general manner, the weights are preferably distributed such that, in a median relative position of the machine frame and of the shuttle frame, halfway between the two end-of-travel positions, stopped on a horizontal rail track, each of the first and second trucks supports at least 40% and at most 60% of the total weight of the tamping machine.

Outside of the work phases themselves, it may be necessary for the machine to travel on a rail track at a travel speed that is substantially higher than the work speed. For this purpose, it is possible to provide a longitudinal locking device which is capable of rigidly connecting the machine frame to the shuttle frame in a position referred to as the travel position, the locking device comprising at least one lock which is capable of withstanding a critical load exceeding 500 kN, preferably 900 kN, and even more preferably 1500 kN, in the longitudinal direction. The critical load will correspond for example to a sudden stop of the machine frame encountering an obstacle.

According to one embodiment, the tamping machine comprises at least one assistance actuator, preferably comprising one or more hydraulic jacks, connecting the machine frame to the shuttle frame, capable of performing one or more of the following operations:

- blocking the shuttle frame with respect to the machine frame in any intermediate position between the two end-of-travel positions;
- driving the shuttle frame with respect to the machine frame in a longitudinal direction of the tamping machine, in a back-and-forth movement between the two end-of-travel positions.

The function of blocking by the assistance actuator will be implemented in particular at very low speed when, during a work sequence, the tamping machine must pass an item of track equipment, for example points.

According to one embodiment, the end-of-travel positions are at least 1 meter, preferably at least 1.5 meters, apart from one another.

According to one embodiment, the first truck is guided in rotation with respect to the shuttle frame so as to pivot at least about a first vertical pivot axis, the second truck is guided in rotation with respect to the shuttle frame so as to pivot at least about a second vertical pivot axis, the second vertical pivot axis preferably being located at a distance (D) from the first vertical pivot axis that is greater than 10 meters, preferably greater than 12 meters.

It is advantageous for the trucks of the tamping machine to ensure suspension of the tamping machine in the movement phases of the tamping machine at a speed higher than the work speed. In contrast, in the work phases, it is advantageous to eliminate the suspension so as to achieve a high degree of positioning accuracy of the tamping tools between the sleepers. For this purpose, and according to a preferred embodiment, it is provided for the first truck and the second truck to each comprise a truck frame, at least two wheel sets, a primary suspension between the wheel sets and the truck frame. Preferably, the primary suspension of each of the first and second trucks comprises a blocking mechanism that is capable of vertically blocking each of the wheel sets with respect to the truck frame, at least in a bearing direction of the truck frame on each of the wheel sets. Preferably, at least one reference truck from the first and second trucks comprises a rotational locking mechanism that is capable of securing the truck frame of the reference truck with respect to the shuttle frame.

According to various embodiments:

- the machine frame comprises a coupling for connection to an adjacent car of the works train;
- at least one longitudinal end of the machine frame is equipped with one or more shock pads;
- the tamping shuttle is entirely located between two opposing longitudinal ends of the machine frame, at least in a median relative position of the machine frame and of the tamping shuttle, halfway between the two end-of-travel positions, and preferably in the two end-of-travel positions;
- the machine frame comprises a driver's cab or a control station.

According to a preferred embodiment, at least one truck from the first truck and the second truck is a motorized truck comprising at least one motorized wheel set. Preferably, each motorized truck comprises two motorized wheel sets, each driven by a traction motor, preferably a hydraulic motor. The two trucks are preferably motorized trucks. The motorized trucks can in particular be used in the work phases, if applicable in addition to the actuator described above, in order to perform the mechanical work necessary for the relative movement between the shuttle frame and the machine frame. They can also be used also in the movement phases of the tamping machine, at a speed higher than the work speed, preferably after having locked the machine frame in position with respect to the shuttle frame. Preferably, at least one truck from the first truck and the second truck is equipped with a break, a motorized truck comprising at least one motorized wheel set that is driven by at least one motor.

According to another aspect of the invention, this relates to a rail works train comprising a tamping machine as described above, and at least one additional car comprising an additional frame coupled to the machine frame of the tamping machine, and at least one additional truck for supporting the additional frame.

According to another aspect of the invention, this relates to a method for operating a works train as defined above on a rail track, method according to which, in a work mode, the machine frame is pulled or pushed by the additional frame of the additional car, on the rail track, in a work direction, preferably without stopping, preferably at a constant speed, the shuttle frame moving longitudinally back-and-forth with respect to the machine frame, so as to have stopping phases, with respect to the rail track, during which the tamping units penetrate the ballast of the rail track, and movement phases in the work direction. Preferably, it is ensured that, in the work mode, the tamping shuttle is driven by one or more motorized trucks from the first and the second truck, and/or by one or more assistance actuators connecting the machine frame to the shuttle frame. Preferably, the method also has a movement mode, in which the machine frame is locked in position longitudinally with respect to the shuttle frame.

BRIEF DESCRIPTION OF THE FIGURES

Other features and advantages of the invention will become clear from the following description, given with reference to the accompanying drawings and explained below.

For reasons of improved clarity, the identical or similar elements are indicated by identical reference signs in all the figures.

DETAILED DESCRIPTION OF EMBODIMENTS

Figure 1:
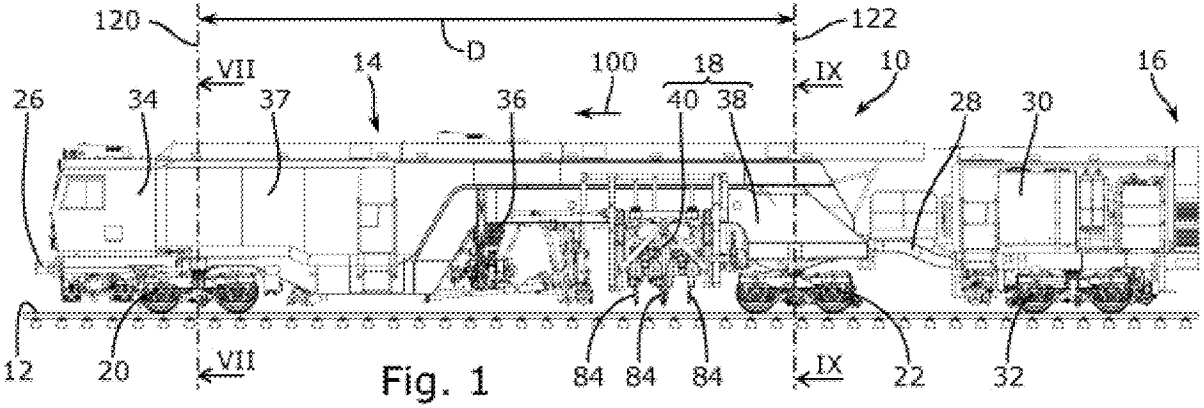
FIG. 1 is a side view of part of a train comprising the work machine and at least one additional car, according to one embodiment of the invention, the work machine comprising a machine frame and a work shuttle in a first end-of-travel position.
Figure 2:
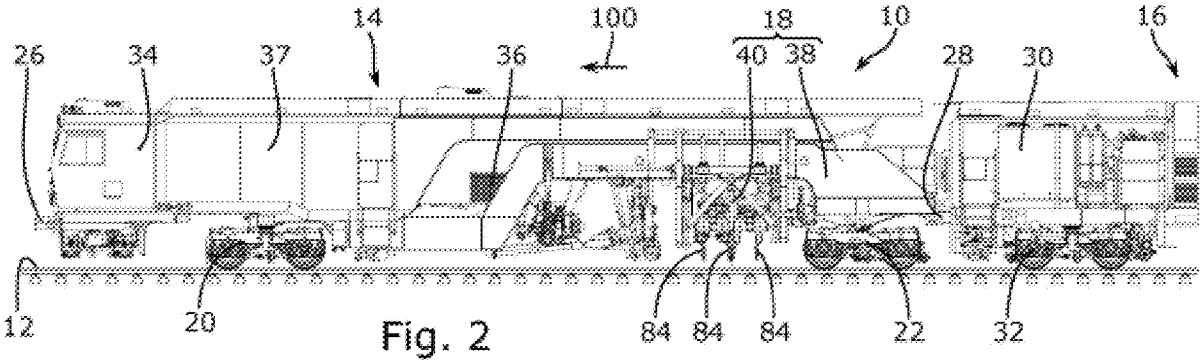
FIG. 2 is a side view of the train of FIG. 1, the work shuttle being in a second end-of-travel position.

FIGS. 1 and 2 show a rail works train 10 for maintaining or repairing a rail track 12, said train comprising a plurality of rail cars that are coupled to one another, i.e. in this case a work train 14 which in this case is a tamping machine, and at least one additional car 16, for example a compacting machine that is located behind the work machine 14, in a direction referred to as the travel direction 100, on the rail track 12.

Figure 3:
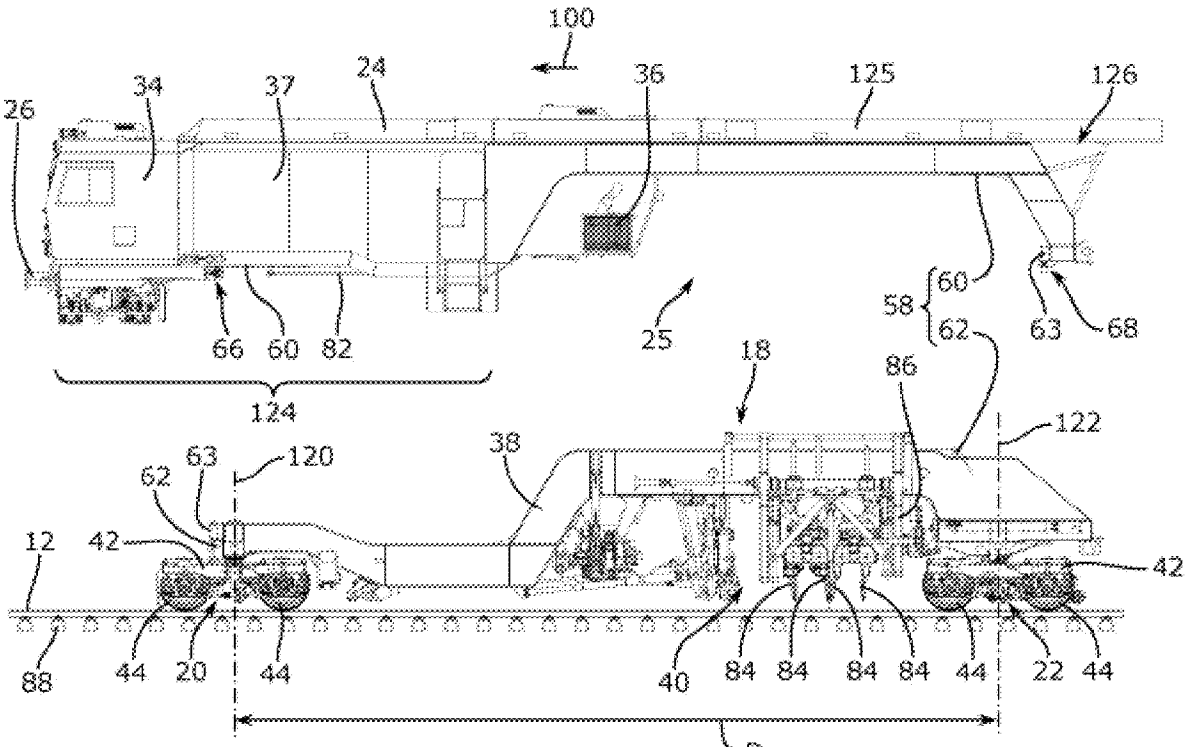
FIG. 3 is an exploded view of the work machine of the train of FIG. 1.

The work machine 14, shown in an exploded view in FIG. 3, comprises a work shuttle 18, in this case more specifically a tamping shuttle, borne by a first truck 20 and a second truck 22 located longitudinally at a distance from one another, as well as a machine frame 24 borne by the work shuttle 18.

The machine frame 24 comprises a longitudinal recess 25 for accommodating the work shuttle 18, said longitudinal recess 25 being spanned by a longitudinal bridge 125 having a small cross section that constitutes a median portion of the machine frame 24 and connects two opposing longitudinal end portions 126, 128 having a larger transverse cross section. The front 126 and rear 128 end portions of the machine frame 24 can be equipped with equipment for interfacing with outer rail vehicles or with track equipment, for example shock pads 26 at the front end 126 and a coupling 28 for connection to the additional car 16 at the rear end 128. As shown in the figure, the additional car 16 comprises an additional frame 30 coupled to the machine frame 24 of the tamping machine 14 and supported in a manner independent of the work machine 12, by at least one additional truck 32. The machine frame 24 is able to support various items of equipment, such as a driver's cab 34 and a control station 36, as well as, if applicable, a hydraulic unit 37 which can comprise, for example, a hydraulic pump for supplying various hydraulic motors located in particular on the work shuttle 18.

The work shuttle 18 comprises a shuttle frame 38 which is borne by the first truck 20 and the second truck 22, as well as one or more work units 40, in this case tamping units, which are suspended on the shuttle frame 38 and are movable with respect to the shuttle frame 38 in a direction perpendicular to the plane defined by the rails of the rail track 12 (i.e. a vertical direction when the work machine 14 is moving on a horizontal rail track 12). The first truck 20 is guided in rotation with respect to the shuttle frame 38 so as to pivot at least about a first vertical pivot axis 120, the second truck 22 is guided in rotation with respect to the shuttle frame so as to pivot at least about a second vertical pivot axis 122, the second vertical pivot axis 122 preferably being located at a distance D from the first vertical pivot axis 120 that is greater than 10 meters, preferably greater than 12 meters.

Figure 5:
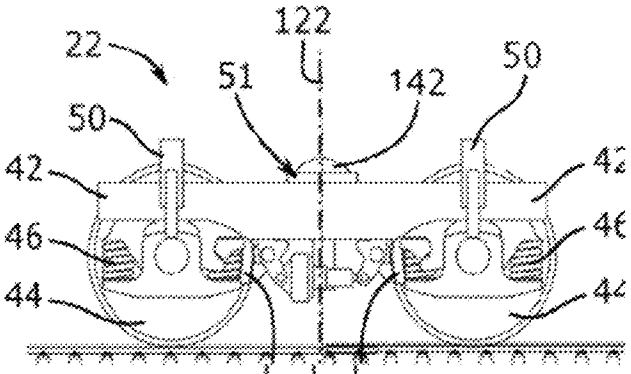
FIG. 5 is a schematic view of a second truck supporting the shuttle frame of the work machine of FIG. 3.
Figure 4:
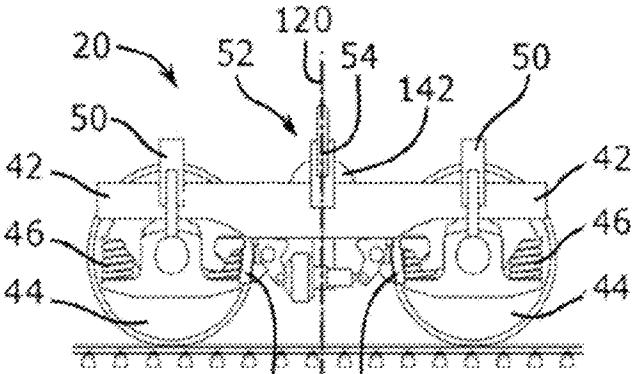
FIG. 4 is a schematic view of a first truck supporting the shuttle frame of the work machine of FIG. 3.

The first truck 20, illustrated in detail in FIG. 4, and the second truck 22, illustrated in FIG. 5, each comprise a truck frame 42, two motorized wheel sets 44 and a primary suspension 46 between the wheel sets 44 and the truck frame 42. The wheel sets 44 are provided with service brakes 48. The primary suspensions 46 of the first truck 20 and of the second truck 22 preferably comprise a blocking mechanism 50 which is capable of vertically blocking each of the wheel sets 44 with respect to the truck frame 42 in at least the downward bearing direction of the truck frame 42 on each of the wheel sets 44. Said blocking mechanism 50 may be made up of hydraulic jacks, the piston of which is rigidly connected for example to the axle box, and the cylinder is rigidly connected to the truck frame 42. The two truck frames 42 are connected to the shuttle frame 38 via a center plate 142.

Figure 6:
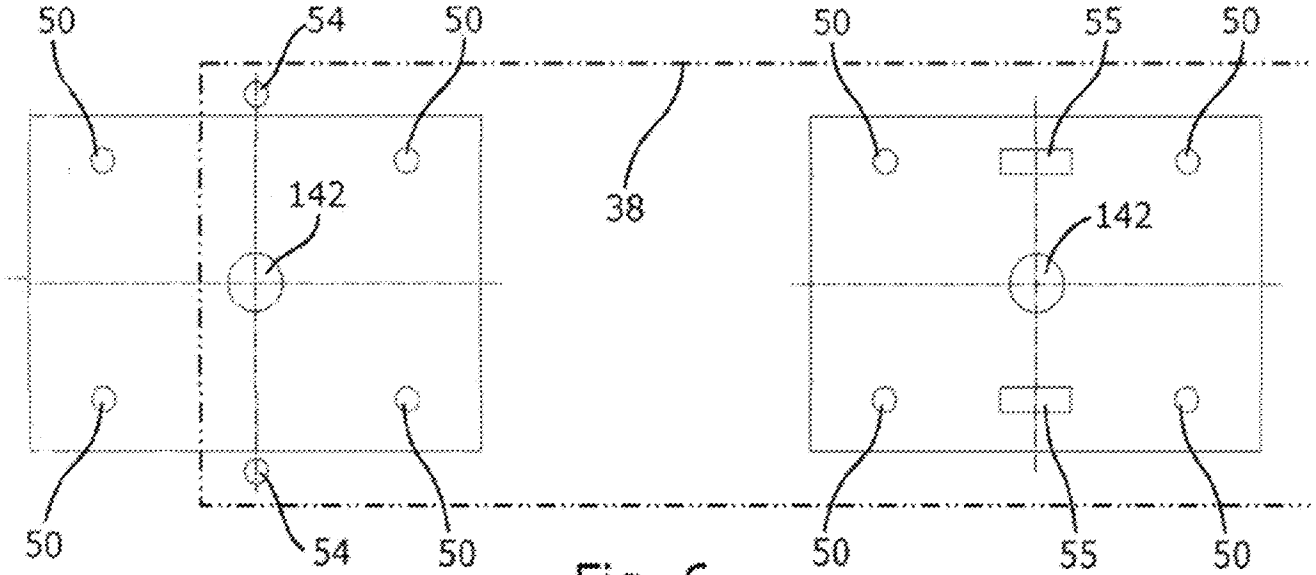
FIG. 6 is a schematic plan view of the two trucks of FIGS. 4 and 5.

Furthermore, at least one of the two trucks 20, 22, for example the first truck 20, which is intended to be positioned in front of the machine when this advances in the work direction 100 on the rail track 12, can be equipped with a vertical blocking device 52 for preventing a vertical relative movement between the truck 20 and the shuttle frame 38. Said device 50 may comprise two retractable lateral support jacks 54 which may be guided hydraulically so as to pass from a retracted position into an operational position in which they constitute two lateral supports between the shuttle frame 38 and the truck frame 42, thus rigidly connecting the truck frame 42 to the shuttle frame 38, in the vertical direction, as shown in FIG. 6, while the rear part of the shuttle frame 38 rests on axle bars 55 with which the truck frame 42 of the second truck 22 is equipped. The shuttle frame 38 can thus retain its horizontal orientation on a horizontal track, or retain a controlled predetermined angle on a sloping track.

The shuttle frame 38 is linked to the machine frame 24 by longitudinal guide structure that allow a relative back-and-forth movement, between two end-of-travel positions, between the work shuttle 18 and the machine frame 24 in a longitudinal direction of the work machine 14, while preventing vertical and lateral movements. Said longitudinal guide structure comprise a first longitudinal rolling interface 56 that is closer to the first truck 20 than to the second truck 22, and a second longitudinal rolling interface 58 that is closer to the second truck 22 than to the first 20, as shown in FIGS. 3 and 7 to 10.

Figure 7:
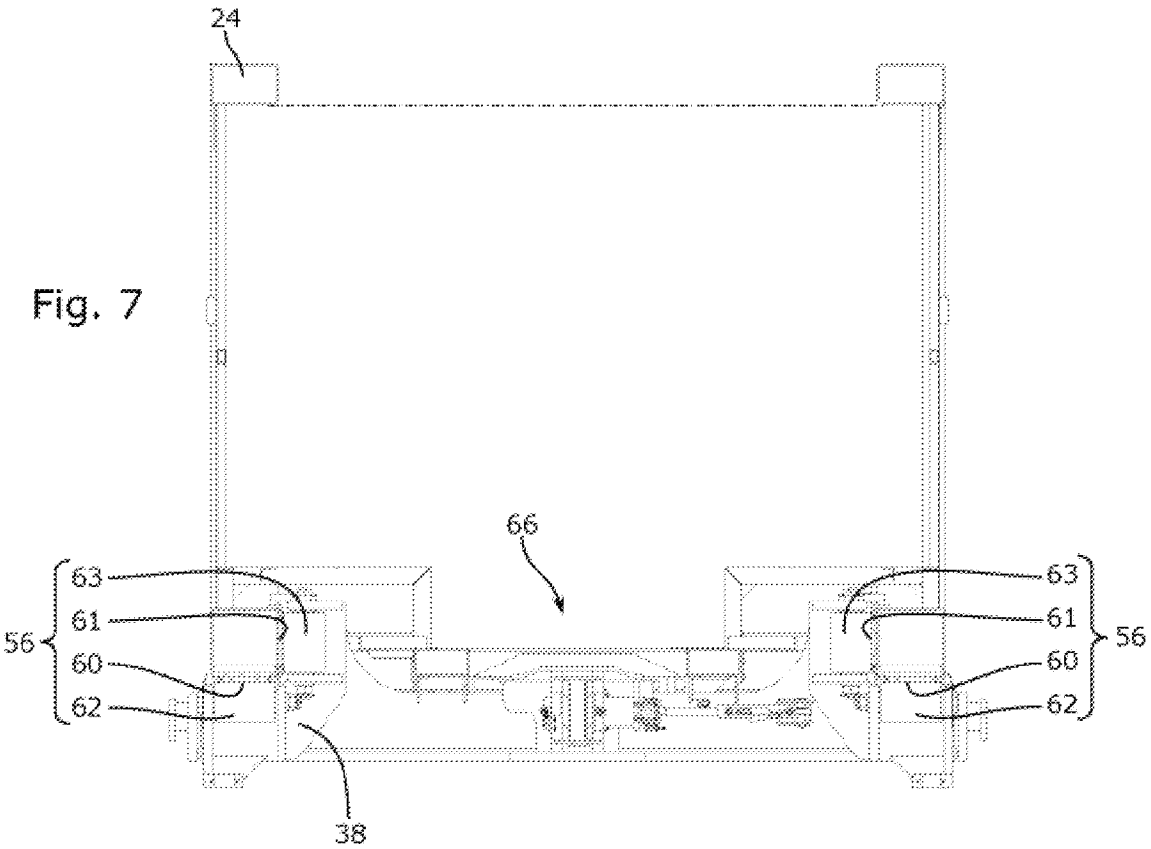
FIG. 7 is a cross-sectional view in a cutting plane VII-VII of FIG. 1, making it possible to see a first rolling interface as well as a first locking device between the machine frame and the shuttle frame.
Figure 8:
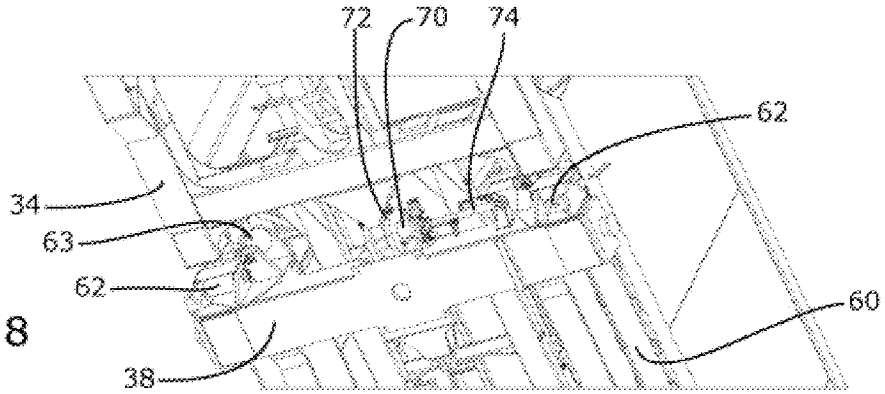
FIG. 8 is an isometric view of the cross section of FIG. 7.
Figure 10:
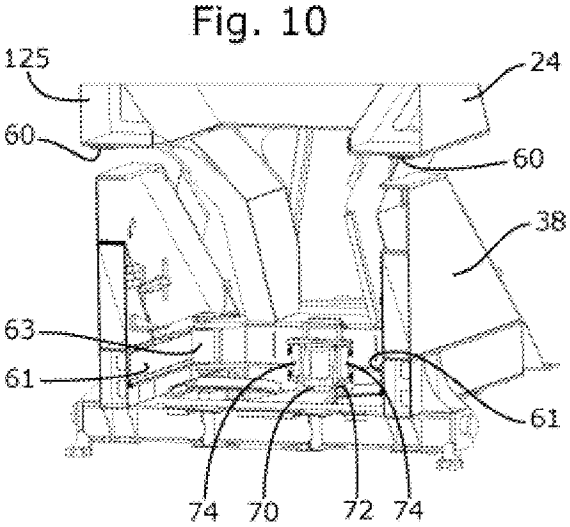
FIG. 10 is an isometric view of the cross section of FIG. 7.
Figure 9:
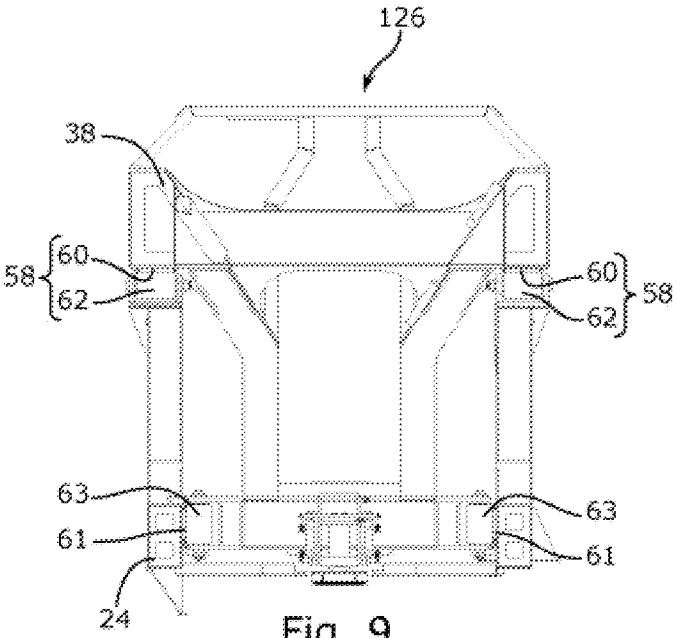
FIG. 9 is a cross-sectional view in a cutting plane IX-IX of FIG. 1, making it possible to see a first rolling interface as well as a first locking device between the machine frame and the shuttle frame.

The first rolling interface 56, illustrated in detail in FIGS. 7 and 8, and the second rolling interface 58, illustrated in detail in FIGS. 9 and 10, each comprise at least one longitudinal raceway 60 and, in this case, each comprise two parallel horizontal longitudinal raceways 60, two parallel vertical longitudinal raceways 61, and at least one roller 62, 63 associated with each longitudinal raceway 60, 61, the roller 62, 63 being capable of rolling on the associated raceway 60, 61 in order to allow for the back-and-forth relative movement between the shuttle frame 38 and the machine frame 24, the longitudinal raceway 60, 61 being rigidly connected to one of the two subassemblies formed by the machine frame 24 and the shuttle frame 38, in this case the machine frame 24, while the associated roller 62, 63 is translationally secured to the other of the subassemblies, i.e. the shuttle frame 38.

Figure 11:
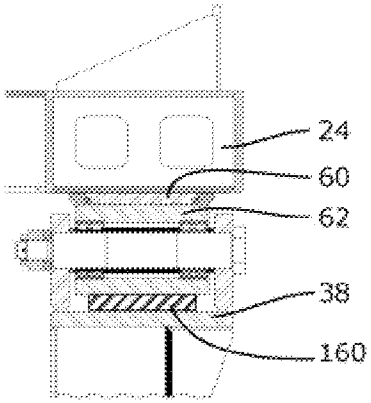
FIG. 11 is a detailed view of an alternative rolling interface between a machine frame and a shuttle frame of the tamping machine of FIG. 3.

In a variant, shown in FIG. 11, it is possible to provide one or more rollers 62, 63 which roll simultaneously on a longitudinal raceway 60, 61 that is rigidly connected to the machine frame 24 and an opposing longitudinal raceway 160 which is rigidly connected to the shuttle frame 38.

The weight of the body of the machine, constituted by the machine frame 24 and the machine elements which it bears, is transmitted integrally to the shuttle frame 38 by the two rolling interfaces 56, 58, which are located on either side of the center of gravity of the body of the machine, such that, when stopped on a horizontal rail track, a load distribution ratio between the first rolling interface 56 and the second rolling interface 58 is between 60% and 140% for every relative position of the machine frame 24 and of the work shuttle 18 between the two end-of-travel positions. Furthermore, the load distribution on the work shuttle 18 and the machine frame 24 is such that, in a median relative position of the machine frame 24 and of the shuttle frame 18, halfway between the two end-of-travel positions, stopped on a horizontal rail track, each of the trucks 20, 22 supports at least 40% and at most 60% of the total weight of the work machine 14.

The work machine 14 is provided with a longitudinal locking device which is capable of rigidly connecting the machine frame to the shuttle frame in a position referred to as the travel position. Said locking device comprises at least two locks 66, 68, which are each located close to a longitudinal end of the shuttle frame 38 and one of the rolling interfaces 56, 58, as shown in particular in FIGS. 7 and 8. The lock 66 comprises a bolt 70 which is mounted on one of the two subassemblies formed by the machine frame 24 and the shuttle frame 38, in this case the shuttle frame 38, and a striker plate 72 which is mounted on the other of the two subassemblies, in this example the machine frame 24. The bolt 70 is movable with respect to the subassembly on which it is mounted, between a retracted position and a locking position, and is connected to an actuator 74, formed in this case by a hydraulic jack. In a similar manner, it can be seen that the lock 68 shown in FIGS. 9 and 10 comprises a bolt 70 which is mounted on one of the two subassemblies formed by the machine frame 24 and the shuttle frame 38, in this case the machine frame 24, and a striker plate 72 which is mounted on the other of the two subassemblies, in this example the shuttle frame 38. The bolt 70 is movable with respect to the subassembly on which it is mounted, between a retracted position and a locking position, and is connected to an actuator 74, formed in this case by two parallel hydraulic jacks.

When the machine frame 24 is positioned in the travel position, with respect to the shuttle frame 38, the bolts 70 of the locks 66, 68, passing from their retracted position into their locking position, penetrate the striker plates 72 and achieve the desired rigid connection, respectively between the front 124 longitudinal end portion of the machine frame 24 and the shuttle frame 38, and between the rear 126 longitudinal end portion of the machine frame 24 and the shuttle frame 38. The shuttle frame 38 and the machine frame 24 thus form a structural entity, such that some of the stresses exerted on the shock pads 26, or more generally the interface at the end 126 of the machine frame 24, is transmitted to the coupling 28, or more generally to the interface at the end 128 of the machine frame, passing via the locks 66, 68 and the shuttle frame 38, relieving the bridge 125 of the machine frame 24 accordingly.

The work machine 14 is preferably equipped with at least one assistance actuator 82 which connects the machine frame 24 to the shuttle frame 38 and has a course of travel that corresponds to the relative course of travel between the shuttle frame 38 and the machine frame 24, between the two end-of-travel positions. Said assistance actuator 82 may be formed by a hydraulic jack, preferably a jack having two chambers. A jack of this kind makes it possible, by isolating each of the chambers, to block the machine frame 24 with respect to the shuttle frame 38, in any intermediate position between the two end-of-travel positions. It also makes it possible to drive the machine frame 24 with respect to the shuttle frame 38 in a back-and-forth movement between the two end-of-travel positions. In a variant, it is possible to provide an actuator that is formed of two hydraulic jacks that are arranged in opposition, each of the jacks managing the blocking in one direction and the movement in the opposite direction.

The work units 40 borne by the shuttle frame comprise picks 84 mounted on a common frame 86 that is guided so as to move vertically with respect to the shuttle frame, between a retracted position, vertically remote from the rail track, and a work position, plunging into the ballast between two adjacent sleepers 88 of the rail track 12. Said picks 84 are motorized so as to be able to vibrate about an average position when they are plunged into the ballast, in order to perform the work operation. However, it is only provided for the frame 86 of the work units 40 to be movable longitudinally with respect to the shuttle frame 38.

If applicable, the work machine 14 and the additional car 16 can be provided so as to function in tandem, for example if it is provided for the additional car 16 to bear a motor group for supplying hydraulic power to the hydraulic drive motors mounted on the trucks 20, 22, or the work units 40.

The work machine 14 functions in the following manner.

In a mode of operation which can be referred to as the work mode, the train 10 advances at a constant work speed, in a predetermined work direction 100, for example towards the left in FIG. 1. Said constant speed is in particular that of the additional car coupled to the work machine, and is thus also that of the machine frame 24. In practice it is very low, by way of example less than 5 km/hour.

In the work mode, the machine frame 24 is pushed by the frame of the additional car 16 located directly behind the work machine 14, or pulled by an additional car located directly in front of the work machine 14, and thus advances at the work speed, in the work direction 100. The work units 40 must, in turn, alternate stationary phases with respect to the track, in order to allow for penetration of the picks 84 into the ballast and the tamping operation, and rapid advance phases. During the stationary phases, the trucks 20, 22 are stationary and the shuttle frame 38, stopped with respect to the rail track 12, progressively moves backwards with respect to the machine frame 24, towards the rear end-of-travel position. During the rapid advance phases, the work units 40 are at a distance from the track, and the shuttle frame 38 accelerates rapidly from the stopped position thereof in the work direction 100, in order to reach a speed higher than the work speed, and to progress forwards with respect to the machine frame and with respect to the track, before decelerating rapidly to a stop, so as to position the work units 40 above the portion of the rail track 12 directly adjacent to the portion already treated. The driving of the shuttle frame 38 can be performed by hydraulic motors for driving motorized wheel sets 44 of the trucks 20, 22, if applicable assisted by the hydraulic jack 82. The decelerations can also be obtained by the hydraulic motors which are driven so as to function as pumps in the case of reversible hydraulic machines, or by the service brakes 48, or by the hydraulic assistance jack 82, or by a combination of these different structure.

The course of travel which the shuttle frame 38 has to cover with respect to the machine frame 24, at each rapid advance phase, in the work direction, is substantially equal to the course of travel covered by the machine frame 24 with respect to the rail track 12, in the work direction 100, during the stationary phase, and thus to the product of the work speed and the stopped time of the shuttle frame 38 with respect to the rail track 12 in the stationary phase. These courses of travel must of course remain within the space delimited by the end-of-travel positions. In practice, the end-of-travel positions are at least 1 meter, preferably at least 1.5 meters, apart from one another.

In the work mode, it is advantageously possible to operate the blocking mechanism 50 of the primary suspensions of the two trucks 20, 22, in order to rigidify the trucks 20, 22. It is also possible to operate the device 52 for vertical blocking of one of the trucks 20 with respect to the shuttle frame 38, for more accurate control of the position of the shuttle frame 38 with respect to the rail track 12, in all spatial directions. Ideally, the blocking device is actuated intermittently, only when the trucks 20, 22 are stopped, and is released when the shuttle advances towards its next work position.

It goes without saying that, in the work operating mode, the longitudinal locking device 66, 68 is not engaged. If it proves necessary, on a construction site, to interrupt the work mode over some meters, for example for the passage of an item of track equipment, such as points, it is possible to use the hydraulic assistance jack 82 as an additional longitudinal locking device.

When they are not in work mode, the work machine 14 and the train 10 are able to travel on the rail track 12 at a speed significantly higher than the work speed, for example at more than 10 km/hour, in order for example to travel to or leave a construction site. In order to allow for a movement of this kind, the blocking mechanism 50 of the primary suspensions 46, as well as the rotational locking device 54 of one of the trucks, are released, and the machine frame 24 is rigidly connected to the shuttle frame 38 in the travel position, by structure of the longitudinal locking device 66, 68.

In practice, the machine frame 24 is positioned, with respect to the shuttle frame 38, precisely in the travel position, by structure of the hydraulic assistance jack 82, or the motorized trucks 20, 22, and then one of the locking devices 66, 68 is engaged. Very slight structural play is retained between the bolt and the striker plate, in order to make it possible, if applicable after very slight position adjustment by structure of the hydraulic assistance jack 82, or motorized trucks 20, 22, to engage the other locking device.

The locks 66, 68 of the longitudinal locking device are dimensioned so as to withstand significant stresses corresponding to a sudden stop of the machine frame 24 when the pads 26 collide with an obstacle when the train 10 is moving at a movement speed that is higher than the work speed. In practice, each of said locks 66, 68 is capable of withstanding a critical load exceeding 500 kN (or if applicable exceeding 900 kN, and preferably exceeding 1500 kN) in the longitudinal direction. Thus, the locks 66, 68 of the longitudinal locking device make it possible to transmit at least some of the buffering stresses longitudinally from the pads 26 to the coupling 28, passing via the locks 66, 68 and the shuttle frame 38. It is thus possible to accept relatively lightweight dimensioning of the machine frame 24 in the thinner part 125 thereof, because the machine frame 24 does not have to transfer all the buffering stresses.

Of course, the examples shown in the drawings and discussed above are given merely by way of example and are non-limiting. It is explicitly provided that it is possible to combine the different embodiments shown with one another, in order to suggest others.

It is emphasized that all the features, as they follow for a person skilled in the art from the present description, the drawings, and the accompanying claims, even if they have been specifically described only in relation with other specific features, both individually and in any combination, can be combined with other features or groups of features disclosed herein, provided that this is not explicitly excluded or that technical circumstances render such combinations impossible or meaningless.

The invention claimed is:

1. A tamping machine comprising a first truck and a second truck that are situated longitudinally at a distance from one another and support the tamping machine, a machine frame and a tamping shuttle, the tamping shuttle having a shuttle frame and one or more tamping units that are vertically movable with respect to the shuttle frame, the shuttle frame being linked to the machine frame by a longitudinal guide structure that allows a relative back-and-forth movement, between two end-of-travel positions, between the shuttle frame and the machine frame in a longitudinal direction of the tamping machine, characterized in that the machine frame is entirely supported by the shuttle frame which is borne by the first truck and the second truck.

2. The tamping machine of claim 1, wherein the longitudinal guide structure comprises a first longitudinal rolling interface that is closer to the first truck than to the second truck, and a second longitudinal rolling interface that is closer to the second truck than to the first.

3. The tamping machine of claim 2, wherein the first rolling interface and the second rolling interface each comprise at least one longitudinal raceway and at least one associated roller which is capable of rolling on the raceway in order to allow for the back-and-forth relative movement between the shuttle frame and the machine frame, the longitudinal raceway being rigidly connected to one of the two subassemblies formed by the machine frame and the shuttle frame, the associated roller being either translationally secured to the other of the subassemblies formed by the machine frame and the shuttle frame, or guided so as to roll simultaneously on the longitudinal raceway and an opposing longitudinal raceway that is rigidly connected to the other of the subassemblies formed by the machine frame and the shuttle frame.

4. The tamping machine of claim 3, wherein the longitudinal raceway of each of the first and second rolling interfaces is rigidly connected to the machine frame, and the associated roller is mounted so as to rotate about a horizontal axis of rotation that is fixed with respect to the shuttle frame, and located longitudinally between at least one wheel set of the first truck and one wheel set of the second truck.

5. The tamping machine of claim 2, wherein the machine frame has a center of gravity that is located between the first rolling interface and the second rolling interface.

6. The tamping machine of claim 1, wherein in a median relative position of the machine frame and of the shuttle frame, halfway between the two end-of-travel positions, stopped on a horizontal rail track, each of the first and second trucks supports at least 40% and at most 60% of the total weight of the tamping machine.

7. The tamping machine of claim 1, wherein it comprises a longitudinal locking device which is capable of rigidly connecting the machine frame to the shuttle frame in a position referred to as the travel position, the locking device comprising at least one lock which is capable of withstanding a critical load exceeding 500 kN in the longitudinal direction.

8. The tamping machine of claim 1, wherein it comprises at least one assistance actuator, comprising one or more hydraulic jacks, connecting the machine frame to the shuttle frame, capable of performing one or more of the following operations:

- blocking the shuttle frame with respect to the machine frame in any intermediate position between the two end-of-travel positions; and
- driving the shuttle frame with respect to the machine frame in a longitudinal direction of the tamping machine, in a back-and-forth movement between the two end-of-travel positions.

9. The tamping machine of claim 1, wherein at least of the following features are implemented:

- the end-of-travel positions are at least 1-1.15 meters apart from one another; or
- the first truck is guided in rotation with respect to the shuttle frame so as to pivot at least about a first vertical pivot axis, the second truck is guided in rotation with respect to the shuttle frame so as to pivot at least about a second vertical pivot axis, the second vertical pivot axis preferably being located at a distance from the first vertical pivot axis that is greater than 10 meters.

10. The tamping machine of claim 1, wherein the first truck and the second truck each comprise a truck frame, at least two wheel sets, a primary suspension between the wheel sets and the truck frame, at least one of the following features being implemented:

- the primary suspension of each of the first and second trucks comprises a blocking mechanism which is capable of vertically blocking each of the wheel sets with respect to the truck frame, at least in a bearing direction of the truck frame on each of the wheel sets; or
- at least one reference truck from the first and second trucks comprises a vertical blocking mechanism that is capable of securing the truck frame of the reference truck with respect to the shuttle frame, in the vertical direction.

11. The tamping machine of claim 1, wherein at least one of the following features are implemented:

- the machine frame comprises a coupling for connection to an adjacent car of the works train;
- at least one longitudinal end of the machine frame is equipped with one or more shock pads;
- the tamping shuttle is entirely located between two opposing longitudinal ends of the machine frame, at least in a median relative position of the machine frame and of the tamping shuttle, halfway between the two end-of-travel positions, and preferably in the two end-of-travel positions; or
- the machine frame comprises a driver's cab or a control station.

12. The tamping machine of claim 1, wherein at least one truck from the first truck and the second truck is a motorized truck comprising at least one motorized wheel set.

13. A rail works train comprising a tamping machine, and at least one additional car comprising an additional frame coupled to the machine frame of the tamping machine, and at least one additional truck for supporting the additional frame.

14. A method for operating a works train on a rail track, wherein, in a work mode, the machine frame is pulled or pushed by the additional frame of the additional car, on the rail track, in a work direction, preferably without stopping, preferably at a constant speed, the shuttle frame moving longitudinally back-and-forth with respect to the machine frame, so as to have stopping phases, with respect to the rail track, during which the tamping units penetrate the ballast of the rail track, and movement phases in the work direction.

15. The method for operating a works train of claim 14, wherein, in the work mode, the tamping shuttle is driven by one or more motorized trucks from the first and the second truck, and by one or more assistance actuators connecting the machine frame to the shuttle frame.

16. The method for operating a works train of claim 14, wherein in a movement mode, the machine frame is locked in position longitudinally with respect to the shuttle frame.

17. The tamping machine of claim 7, wherein the locking device comprising at least one lock which is capable of withstanding a critical load exceeding 1000 kN in the longitudinal direction.

18. The tamping machine of claim 17, wherein the locking device comprising at least one lock which is capable of withstanding a critical load exceeding 1500 KN in the longitudinal direction.

* * * * *